350-332 SR
2/24/87 XR 4,646,074

United States Patent [19]
Hashimoto

[11] Patent Number: 4,646,074
[45] Date of Patent: Feb. 24, 1987

[54] DOT MATRIX DISPLAY WITH DRIVER CIRCUIT ON THE SAME PLANE

[75] Inventor: Shintaro Hashimoto, Ikoma, Japan

[73] Assignee: Sharp Kabushiki Kaisha, Osaka, Japan

[21] Appl. No.: 577,799

[22] Filed: Feb. 7, 1984

[30] Foreign Application Priority Data

Feb. 10, 1983 [JP] Japan ..... 58-21346

[51] Int. Cl.[4] ..... G09G 3/02
[52] U.S. Cl. ..... 340/718; 340/719; 340/765; 340/784; 350/332
[58] Field of Search ..... 340/718, 719, 765, 784, 340/815.27; 350/332

[56] References Cited

U.S. PATENT DOCUMENTS 4,367,467 1/1983 Emile, Jr. ..... 340/718
4,461,401 7/1984 Sasnett, Jr. ..... 340/718
4,477,805 10/1984 Arton et al. ..... 340/784
4,506,261 3/1985 Lawter ..... 340/718

FOREIGN PATENT DOCUMENTS 2910779 9/1980 Fed. Rep. of Germany ..... 340/784
2122013 1/1984 United Kingdom ..... 340/719

*Primary Examiner*—Gerald L. Brigance
*Assistant Examiner*—Jeffery A. Brier
*Attorney, Agent, or Firm*—Birch, Stewart, Kolasch & Birch

[57] ABSTRACT

A dot matrix display device provides both dot matrix display elements and driver circuit substantially on the same circuit board. Display control signals are serially transmitted to the dot matrix display element driver circuit. Such a configuration enables a display panel containing a large number of dots in fine pitches to be easily connected to its driver circuit.

4 Claims, 7 Drawing Figures

DOT MATRIX DISPLAY WITH DRIVER CIRCUIT ON THE SAME PLANE

BACKGROUND OF THE INVENTION

The present invention relates to a dot matrix display device, more particularly, to a liquid crystal display device (referred to as "LCD" hereinafter) which contains a large number of dots and a large screen.

Due to the improved quality of LCD material, the modern LCD dot matrix display device can conntain a greater number of dots. Likewise, by coloring with three different colors transparent electrodes of either the guest/host or twisted nematic type LCD device, color-display LCD devices have been developed. These devices, however, contain an extremely large number of dots in very fine terminal pitches. On the other hand, when using such a display device containing a large number of dots, means for electrically and mechanically connecting the display device to the driver circuit often becomes a critical problem. In other words, since the number of terminals should be increased corresponding to the number of dots being used and the terminal pitches, the space between the respective terminals, tend to be finer than before, they have to be positioned with accuracy. At the same time, when incorporating such a LCD device in a small apparatus, a critical problem lies in the method for minimizing the configuration of connection parts. cl OBJECT AND SUMMARY OF THE INVENTION The present invention primarily aims at eliminating the problem mentioned above. According to an embodiment of the present invention, a dot matrix display device provided with dot matrix display elements and a driver circuit on the same circuit board, comprises the driver circuit being set to a position close to terminals of the dot maxtrix display elements and a display data control circuit that serially transmits the contents read out of a memory storing the display data to the driver circuit. A preferred embodiment of the present invention thus summarized above provides the following advantages.

(1) Since the number of wires needed for connecting the display device and the display control circuit is minimized, they can be easily and correctly set to the designated positions, ensuring stable connection to each other.

(2) Since parts and space needed for connection can be minimized, the entire configuration can be compact.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
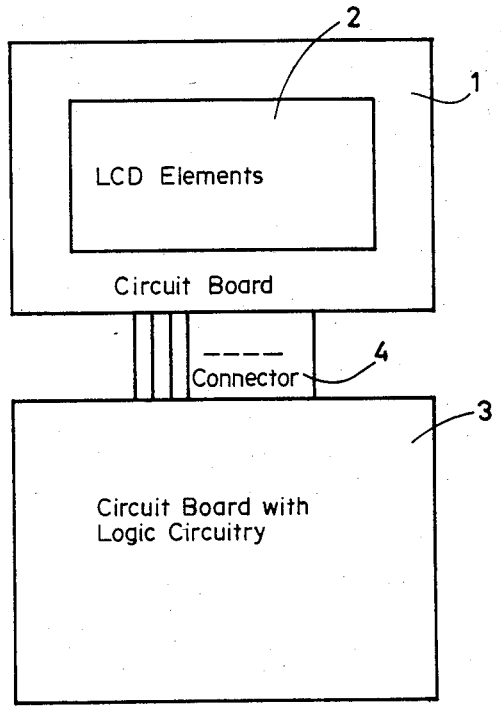
FIG. 1 shows a configuration of an apparatus incorporating a display device embodied by the present invention.

FIG. 1 shows a configuration of an apparatus incorporating a display device embodied by the present invention.

Reference number 1 denotes a circuit board containing a circuit that drives dot matrix display elements. Reference number 2 denotes LCD elements being pressed against and connected to the circuit board 1. Both the circuit board 1 and the LCD elements 2 are respectively pressed and connected to each other via conventional rubber connectors such as "Zebra Rubber". Reference number 3 denotes a circuit board containing a RAM that memorizes information to be displayed and other logic circuits for activating a variety of functions as a display device. The circuit boards 1 and 3 are connected to each other via a connector 4. The preferred embodiment of the present invention has made it possible to minimize the number of signal wires of the connector 4, and as a result, the connector 4 can connect the circuit boards 1 and 3 very easily using a minimum amount of space.

Figure 2:
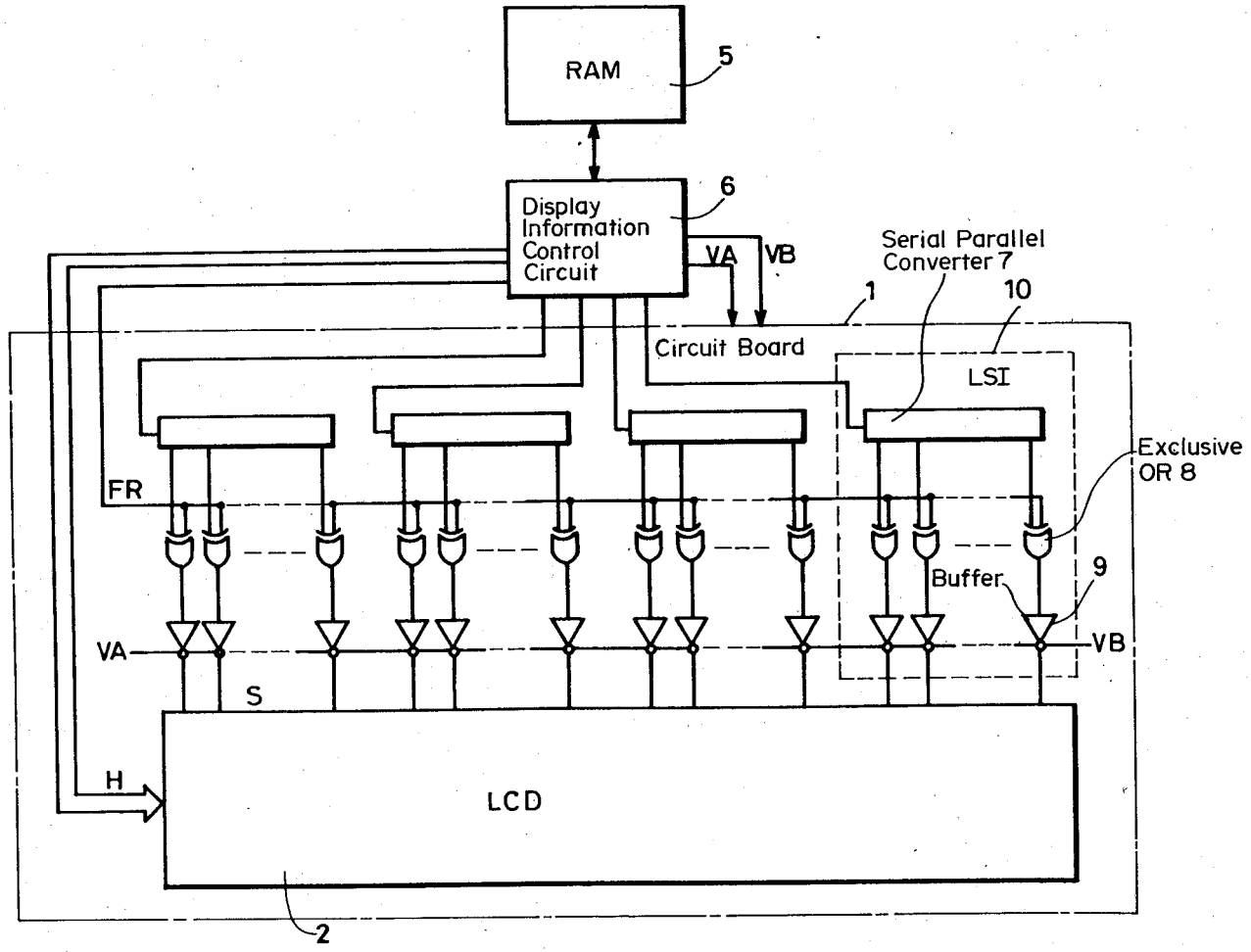
FIG. 2 shows a control circuit driving the display elements of the display device.

FIG. 2 shows a control circuit for driving the display elements. Reference number 1, rectangular box defined by a chain line is exactly identical to the circuit board 1 shown in FIG. 1, containing both the display elements 2 and the driver circuit driving these elements. Reference number 5 denotes a RAM memorizing information to be displayed. Reference number 6 denotes a display information control circuit that sequentially reads the contents of the RAM 5 before sending display signals to the circuit board 1. Both the RAM 5 and the display information control circuit 6 are placed in the circuit board 3 shown in FIG. 1. Reference number 7 is a circuit for converting serial input data into parallel output data. Reference number 8 is an exclusive OR gate and 9 is a voltage conversion buffer. The signal from the buffer 9 becomes segment signal S. The units 7, 8, and 9 are composed of an LSI 10 as one unit. In FIG. 2, four units of the LSI 10 drive the entire dots of the LCD elements 2.

The display information control circuit 6 outputs a variety of signals and voltages, i.e., a data signal being fed to the serial-parallel conversion circuit 7, a common signal H, frame inversion signal FR being fed to the back plate of the LCD elements 2, and voltages VA and VB being sent to the voltage conversion circuit 9. The RAM 5 memorizes dot patterns to be displayed by using bit-images.

Figure 3:
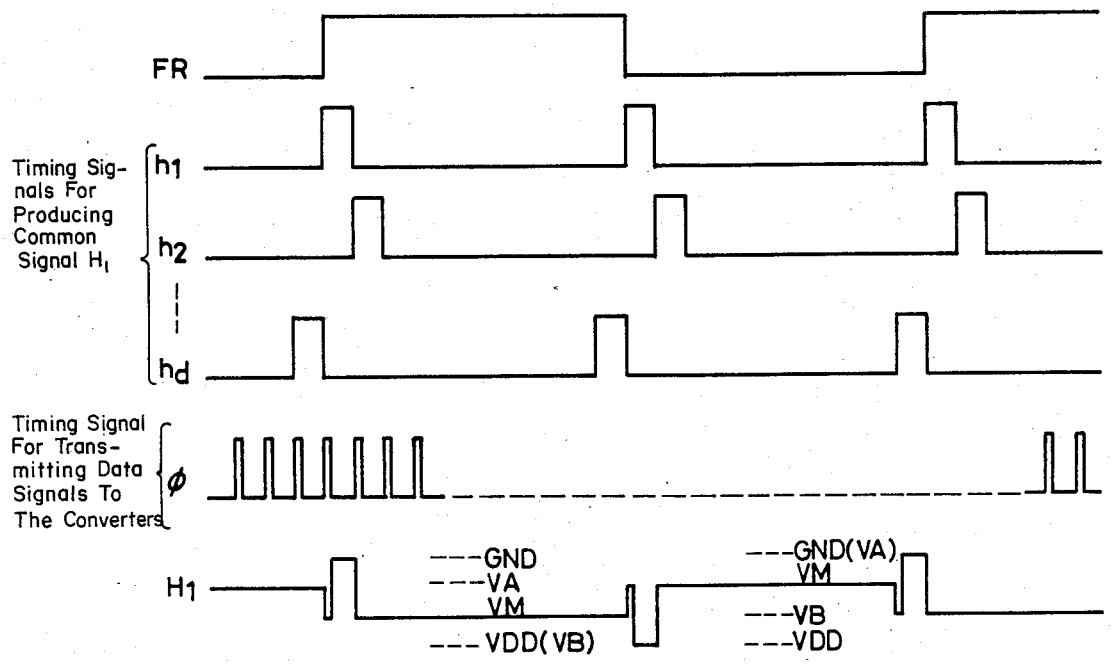
FIG. 3 shows signal waveforms for the display operation of the display device.

As is clear from the above description, even if there are a large number of dots in the LCD elements, the number of signal lines sending signals to the circuit board 1 can be minimized. Waveforms showing signal operation via the minimized signal lines are shown in FIG. 3. References h1, h2, - - - hd respectively denote timing signals for generating common signals H1 - - - . Reference $\phi$ denotes a timing signal for transmitting data signals to each of the serial-parallel conversion circuits 7. H1 is one of the common signals, which is generated by signals h1, $\phi$, FR, and voltages VA and VM. To prevent incorrect illumination during the signal $\phi$ timing period, voltage VM is sent to the common signal H1.

Figure 4:
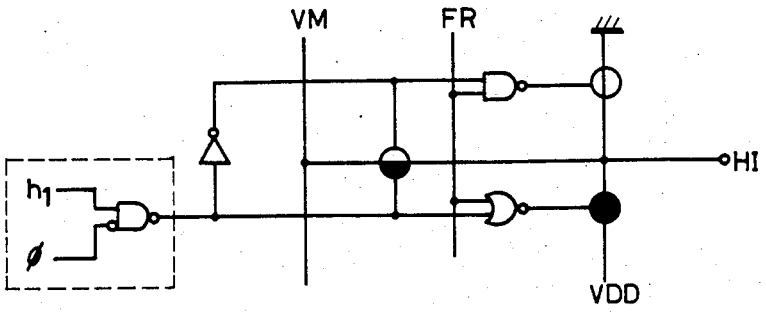
FIG. 4 is a circuit diagram generating common signal H1 shown in FIG. 3.

FIG. 4 shows a circuit diagram generating common signals. As shown by the dotted line, a non-selective signal is sent to this circuit by the effect of signal $\phi$. Further details are deleted since the other parts are well known.

Figure 5:
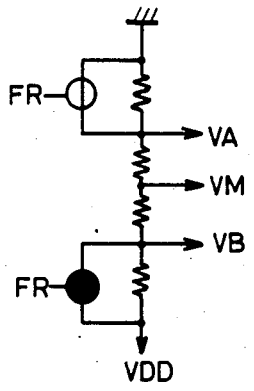
FIG. 5 is a circuit diagram generating voltages VA, VM, and VB shown in FIGS. 2 to 4.
Figure 6:
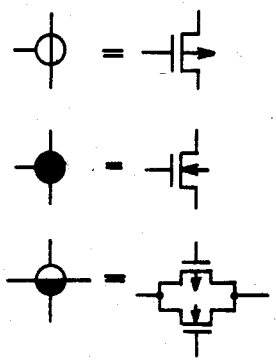
FIG. 6 is the relationship between codes shown in FIGS. 4 and 5 and the MOS circuit codes.
Figure 7:
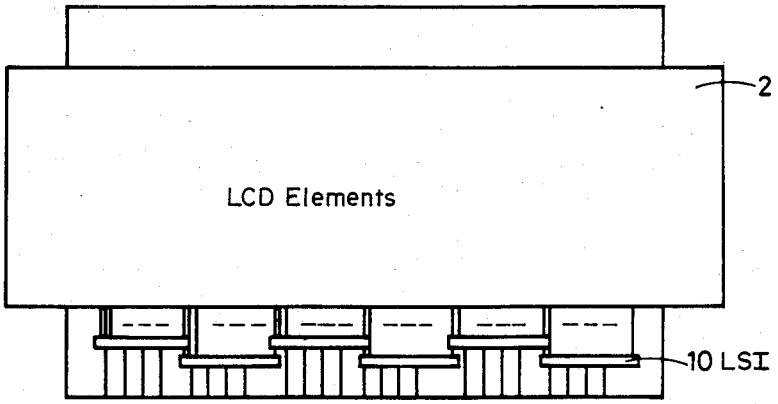
FIG. 7 is another preferred embodiment of the present invention.

FIG. 5 shows a circuit diagram generating voltages VA, VM, and VB. FIG. 6 shows the relationship between reference symbols shown in FIGS. 4 and 5 and MOS circuit symbols. FIG. 7 shows another preferred embodiment of the present invention. This embodiment denotes a confirguration in which a plurality of LSIs 10 are directly bonded to portions close to the circuit terminals of the LCD elements 2 for driving segments. These LSI units are exactly identical to those LSIs 10 shown in FIG. 2, which can be externally connected via minimum number of terminals. By correctly matching the terminal pitches, of the LSI 10 and the display element segment, LSI units can be bonded effectively even in an extremely narrow space. Charge coupled elements can also be used for the segment driving LSIs.

As described above, a dot matrix display device of the present invention that provides dot matrix display elements and a driver circuit driving the elements, comprises a circuit board carrying said dot matrix display elements and said driver circuit so that said driver circuit is set in a position close to terminals of said dot matrix display elements, a memory for storing information for display, and a display information control circuit that causes the data contents read out of said memory to be serially transmitted to said driver circuit.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A dot matrix display device that displays display information stored in a memory, comprising:

driving control means for producing a plurality of control signals, said plurality of control signals including, a plurality of serial data signals, each of said plurality of serial data signals representing display information read out of the memory, a common signal and a frame inversion signal;

a circuit board;

a plurality of display elements mounted to said circuit board and responsive to said common signal and having circuit terminals; and driving means, responsive to said plurality of control signals and connected to said circuit board, for driving said plurality of display elements to display information read out of the memory, said driving means comprising, a plurality of serial to parallel data converters converting said serial data signals into a plurality of parallel data signals, gating means, operatively connected to said serial to parallel data converters, for gating each of said plurality of parallel data signals with said frame inversion signal to produce a plurality of gate output signals, and signal buffer means, operatively connected to said gating means, for producing a segment signal from each of said plurality of gate output signals, said segment signals collectively forming display driving signals for said plurality of display elements.

2. The dot matrix display device of claim 1 wherein said driving means develops said display driving signals on a plurality of driving terminals, said driving terminals being aligned with said circuit terminals in juxtaposition therewith.

3. The dot matrix display device of claim 2 wherein said driving terminals are connected to said plurality of display elements by directly bonding said driving means to said circuit terminals.

4. The dot matrix display device of claim 2 wherein said driving terminals are connected to said plurality of display elements by external wiring with a connector.

* * * * *